US008752727B2

(12) United States Patent
Niemann

(10) Patent No.: US 8,752,727 B2
(45) Date of Patent: Jun. 17, 2014

(54) CONTAINER WITH HINGE PIN LOCK

(75) Inventor: Hans Niemann, Cross Junction, VA (US)

(73) Assignee: Monoflo International, Inc., Winchester, VA (US)

( * ) Notice: Subject to any disclaimer, the term of this patent is extended or adjusted under 35 U.S.C. 154(b) by 0 days.

(21) Appl. No.: 13/610,199

(22) Filed: Sep. 11, 2012

(65) Prior Publication Data

US 2014/0069949 A1 Mar. 13, 2014

(51) Int. Cl.
*B65D 43/00* (2006.01)
*B65D 51/04* (2006.01)
*B65D 43/14* (2006.01)

(52) U.S. Cl.
CPC ..... *B65D 43/14* (2013.01); *B65D 51/04* (2013.01)
USPC ..... 220/810; 220/844; 220/840; 220/841; 220/822; 220/836; 16/221; 16/257; 16/380; 16/265

(58) Field of Classification Search
CPC ..... B65D 2543/00324; B65D 21/06; B65D 51/04; B65D 85/62; B65D 43/161; B65D 43/14; B65D 9/18; B65D 5/6605; B65D 5/6608; B65D 43/16; E05D 15/50
USPC ..... 220/840, 826, 836, 827, 337, 334, 129, 220/335, 844, 810, 819, 822, FOR. 195, 220/FOR. 197, FOR. 198, FOR. 201; 16/257, 16/221, 256, 266, 262, 387, 379, 380, 265, 16/326, 177, 259, 267; 206/506, 505, 507, 206/511, 518
See application file for complete search history.

(56) References Cited

U.S. PATENT DOCUMENTS

| | | | | | |
|---|---|---|---|---|---|
| 3,178,761 | A | * | 4/1965 | Restaino | 16/257 |
| 3,463,345 | A | * | 8/1969 | Bockenstette | 220/826 |
| 3,655,088 | A | * | 4/1972 | Box | 220/826 |
| 3,979,016 | A | * | 9/1976 | Frater | 220/315 |
| 4,109,791 | A | * | 8/1978 | Clipson et al. | 206/506 |
| 4,161,261 | A | * | 7/1979 | Frater | 220/826 |
| 4,216,862 | A | * | 8/1980 | Daenen | 206/541 |
| 4,282,983 | A | * | 8/1981 | Swartzbaugh | 220/832 |
| 4,358,871 | A | * | 11/1982 | Takai | 16/262 |
| 4,432,467 | A | * | 2/1984 | Swingley, Jr. | 220/826 |
| 4,466,541 | A | * | 8/1984 | Tabler et al. | 206/506 |
| 4,470,517 | A | * | 9/1984 | Carrier | 220/840 |
| 4,589,148 | A | * | 5/1986 | Cameron | 4/236 |
| 4,663,803 | A | * | 5/1987 | Gora | 16/266 |
| 4,685,567 | A | * | 8/1987 | Webb | 206/506 |
| 4,848,578 | A | * | 7/1989 | Schafer | 206/506 |
| 4,863,062 | A | * | 9/1989 | Holliday | 220/845 |
| 4,892,221 | A | * | 1/1990 | Gora et al. | 220/826 |
| 5,048,715 | A | * | 9/1991 | Wolff | 220/832 |
| 5,051,725 | A | * | 9/1991 | Caccitolo | 340/571 |
| 5,070,577 | A | * | 12/1991 | Bonneville et al. | 16/260 |
| 5,146,650 | A | * | 9/1992 | Robertson | 16/259 |
| 5,267,866 | A | * | 12/1993 | Swift et al. | 439/31 |
| 5,328,048 | A | * | 7/1994 | Stein | 220/826 |

(Continued)

*Primary Examiner* — Mickey Yu
*Assistant Examiner* — Gideon Weinerth
(74) *Attorney, Agent, or Firm* — Nixon & Vanderhye P.C.

(57) ABSTRACT

A hinge pin lock for a molded plastic container includes a locking tab molded with an upper rim of the container and connected to the upper rim by a living hinge. The locking tab is pivotable from an open position to a locked position. A channel is formed in the upper rim and is sized to receive a hinge pin of a container lid. The channel includes engagement structure that secures the locking tab in the locked position.

13 Claims, 4 Drawing Sheets

(56) References Cited

U.S. PATENT DOCUMENTS

| | | | | | |
|---|---|---|---|---|---|
| 5,353,948 | A * | 10/1994 | Lanoue et al. | 220/826 |
| 5,361,456 | A * | 11/1994 | Newby, Sr. | 16/257 |
| 5,381,920 | A * | 1/1995 | Lin | 220/843 |
| 5,474,200 | A * | 12/1995 | Nicholson | 220/844 |
| 5,537,713 | A * | 7/1996 | Docteur | 16/2.1 |
| 5,673,791 | A * | 10/1997 | Jamison | 206/508 |
| 5,706,555 | A * | 1/1998 | Furtner | 16/267 |
| 6,000,576 | A * | 12/1999 | Liu | 220/826 |
| 6,047,853 | A * | 4/2000 | Frankenberg | 220/844 |
| 6,338,181 | B1 * | 1/2002 | Hwang | 16/266 |
| D493,282 | S * | 7/2004 | Dubois et al. | D3/273 |
| 6,810,562 | B1 * | 11/2004 | Horne et al. | 16/254 |
| 6,868,979 | B2 | 3/2005 | Rader | |
| 7,090,095 | B2 * | 8/2006 | Schafer | 220/826 |
| 7,370,771 | B2 | 5/2008 | Rader | |
| 7,380,310 | B2 * | 6/2008 | Koessler | 16/267 |
| 7,841,487 | B2 * | 11/2010 | Miller et al. | 220/826 |
| 8,066,143 | B2 * | 11/2011 | Baltz et al. | 220/324 |
| 8,261,410 | B2 * | 9/2012 | Sze | 16/266 |
| 8,286,828 | B2 * | 10/2012 | Schafer | 220/826 |
| 2004/0144793 | A1 * | 7/2004 | Lessard et al. | 220/836 |
| 2005/0103797 | A1 * | 5/2005 | Rader et al. | 220/844 |
| 2006/0288532 | A1 * | 12/2006 | Kim | 16/267 |
| 2012/0255965 | A1 * | 10/2012 | King | 220/826 |
| 2012/0279980 | A1 * | 11/2012 | Koefelda et al. | 220/826 |

* cited by examiner

CONTAINER WITH HINGE PIN LOCK

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The invention relates to a molded plastic container and, more particularly, to such a container with a hinge pin lock and a molded plastic lid with integrated plastic hinge pins.

Molded plastic containers come in various designs. The materials are inexpensive and durable and are used worldwide for shipping and storage applications. In a current design, a container includes a lid that is secured using metal hinge pins. Metal pins advantageously provide a strong connection of the lid to the container, and assembly of the container can be automated. The metal hinge pins also provide very good tamper resistance. These features are important for industrial applications. The metal hinge pins, however, have some negative attributes as they add cost, are more difficult to recycle, are more difficult to assemble, and can even cause injuries.

It would be desirable to provide a container that can maintain the advantages of the metal pins while using an integrated plastic hinge. Generally, plastic hinge lids and integrated hinge pins can be attached to a container with simple snap-in hinges. These constructions, however, do not provide sufficient rigidity and tamper resistance and typically have been used for less demanding applications.

BRIEF SUMMARY OF THE INVENTION

According to preferred embodiments, a molded plastic container may be provided with a locking feature that can serve to lock a container lid with plastic hinge pins to thereby achieve the advantages of a metal hinge pin without the disadvantages. The lid lock is preferably connected to the container via a living hinge and molded with the container.

In an exemplary embodiment, a hinge pin lock is provided for a molded plastic container. The hinge pin lock includes a locking tab molded with an upper rim of the container and connected to the upper rim by a living hinge. The locking tab is pivotable from an open position to a locked position. A channel is formed in the upper rim and is sized to receive a hinge pin of a container lid. The channel includes engagement structure that secures the locking tab in the locked position.

The locking tab may include at least one hook that engages the engagement structure in the locked position. The locking tab preferably includes two hooks on opposite sides thereof, where the hooks engage the engagement structure in the locked position. The hooks may be provided with a reverse tapered surface and a shelf, where the engagement structure includes shoulders corresponding to each shelf of the hooks. The shelf of each hook may engage a corresponding one of the shoulders in the locked position.

An inside surface of the locking tab may include a curved recess that is shaped to accommodate the hinge pin. In this context, the channel may define a curved pocket that is shaped to accommodate the hinge, where the curved recess and the curved pocket define a substantially cylindrical cage for the hinge pin.

In another exemplary embodiment, a container includes a container body including an upper rim, a container lid pivotably secured to the upper rim via a hinge pin, and the hinge pin lock formed in the upper rim and securing the hinge pin. The container lid may include a plurality of integral hinge pins, where the upper rim includes a plurality of pin channels. The integral hinge pins are secured in the pin channels. The container body may include two long sides and two short sides, where the pin channels are positioned along the long sides, and the container includes four hinge pin locks spaced along each of the long sides. In one arrangement, the pin channels are constructed such that the hinge pins are secured in the pin channels in a snap fit.

An inside surface of the locking tab may include a curved recess that is shaped to accommodate the hinge pin. In this context, the channel may define a curved pocket that is shaped to accommodate the hinge, where the curved recess and the curved pocket define a substantially cylindrical cage for the hinge pin.

In yet another exemplary embodiment, a method of making a plastic container includes the steps of (a) molding a container body including an upper rim, and (b) molding a container lid pivotably securable to the upper rim via an integrally molded hinge pin. Step (a) includes integrally molding a hinge pin lock in the upper rim by (1) molding a locking tab with the upper rim and connecting the locking tab to the upper rim by a living hinge, where the locking tab is pivotable from an open position to a locked position, and (2) molding a lock channel in the upper rim to receive the hinge pin of the container lid. Molding the lock channel may include molding engagement structure with the lock channel that is shaped to secure the locking tab in the locked position.

Step (b) may include molding the container lid with a plurality of hinge pins, and step (a) may include forming a plurality of pin channels in the upper rim. In this context, assembling the plastic container may be practiced by securing the hinge pins of the container lid in the pin channels of the container body, securing at least one of the hinge pins in the lock channel, and pivoting the locking tab from the open position to the locked position to lock the at least one of the hinge pins in the lock channel.

BRIEF DESCRIPTION OF THE DRAWINGS

These and other aspects and advantages will be described in detail with reference to the accompanying drawings, in which.

DETAILED DESCRIPTION OF THE INVENTION

Figures 1, 2, 3:
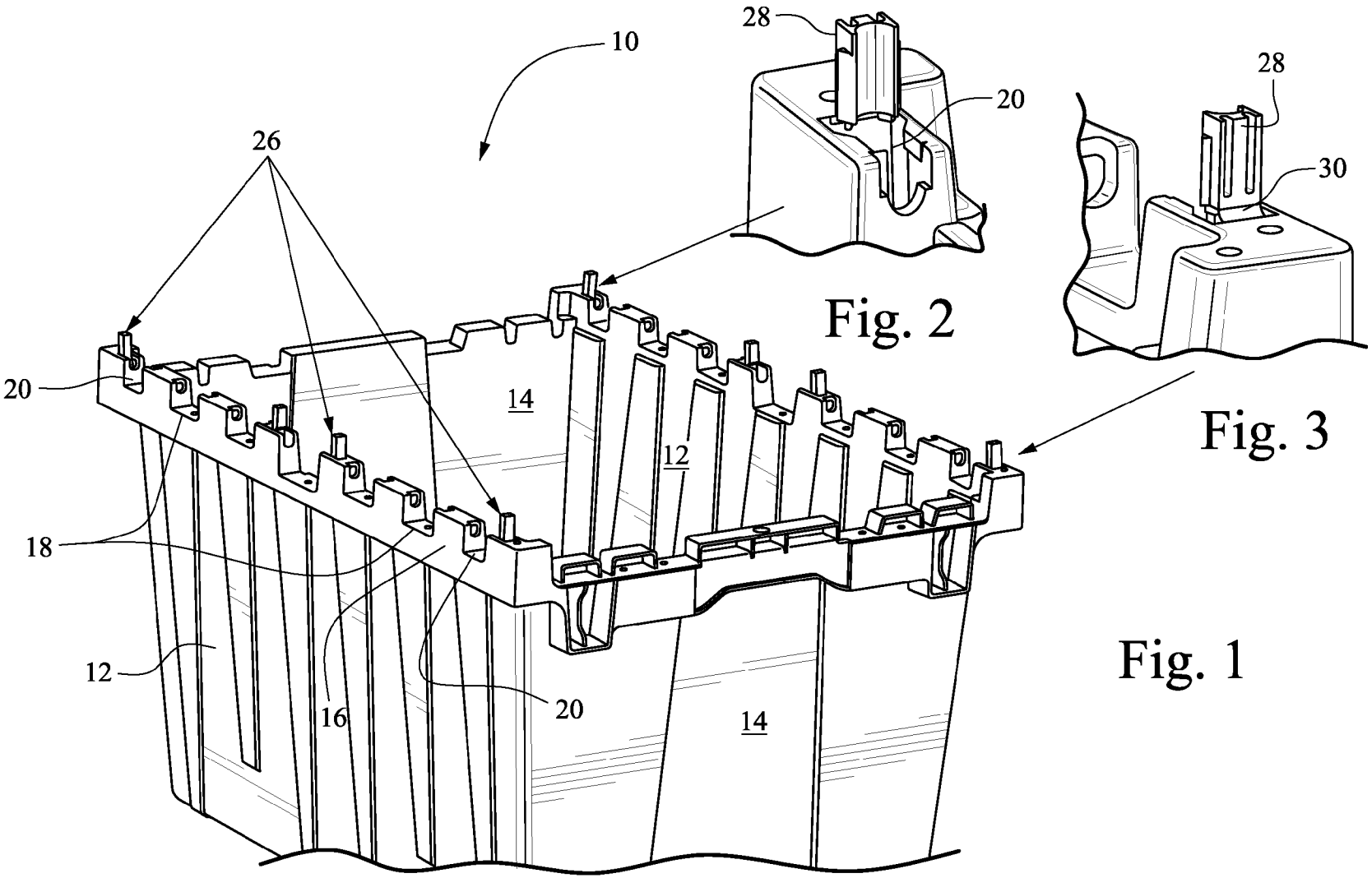
FIG. 1 is a perspective view of a molded plastic container including hinge pin locks.
FIGS. 2 and 3 are close-up views of the hinge pin locks.

With reference to the drawings, a molded plastic container 10 includes long sides 12, short sides 14 and an upper rim 16. The upper rim is provided with a plurality of pin channels 18 as well as one or more lock channels 20.

A container lid 22 may be formed in two parts, one each pivotally attached to the container long sides 12 by a plurality of integrated hinge pins 24. The lid 22 is secured to the container 10 from the top preferably via a snap-in construction of the hinge pins 24 into the pin channels 18 and lock channels 20.

Figure 4:
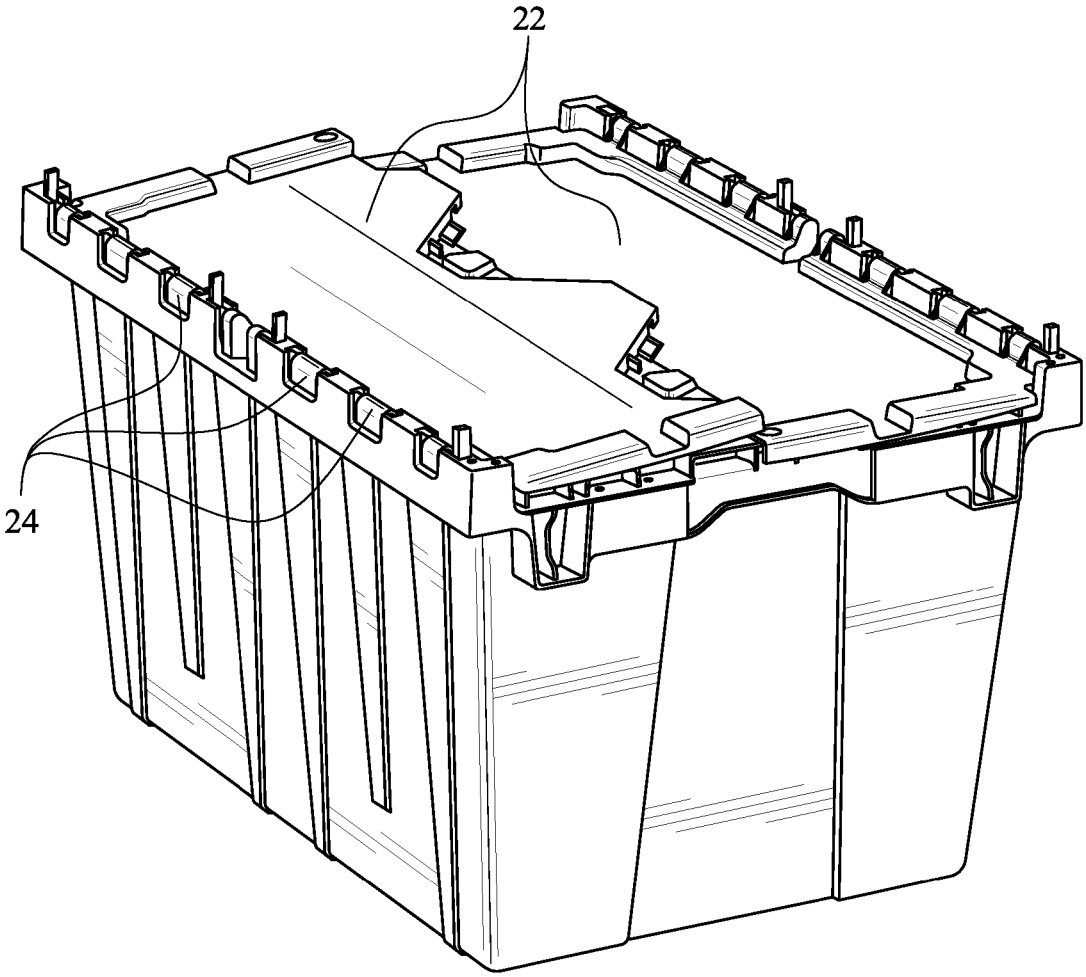
FIG. 4 is a perspective view of the container with a container lid attached and the hinge pin locks in an open position.
Figure 5:
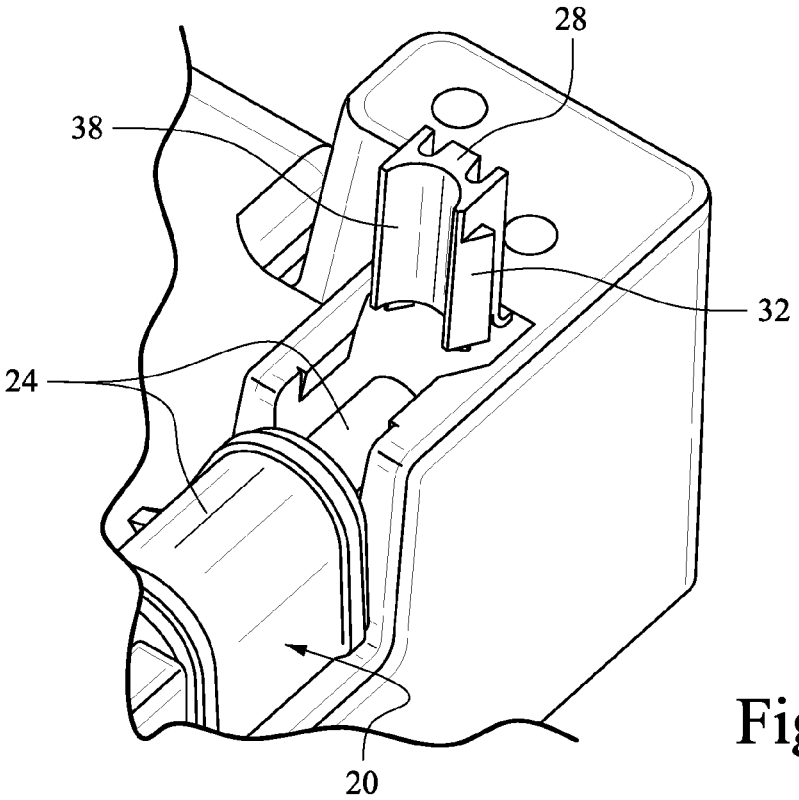
FIGS. 5 and 6 are close-up views of the hinge pin lock in the open and locked positions, respectively.
Figure 6:
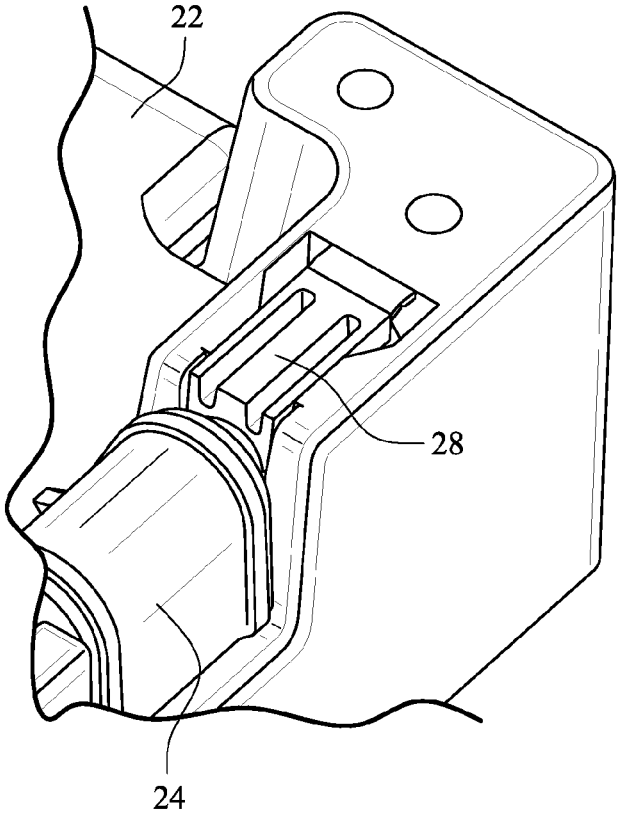

The container 10 also includes one or several hinge pin locks 26 that serve to lock a corresponding one or several hinge pins in a respective lock channel 20. As shown in FIGS. 1 and 4, the container is preferably provided with four hinge pin locks 26 spaced along each of the long sides 12 of the container 10. Each hinge pin lock 26 includes a locking tab 28 integrally molded with the upper rim 16 of the container 10 and connected to the upper rim by a living hinge 30.

Figure 7:
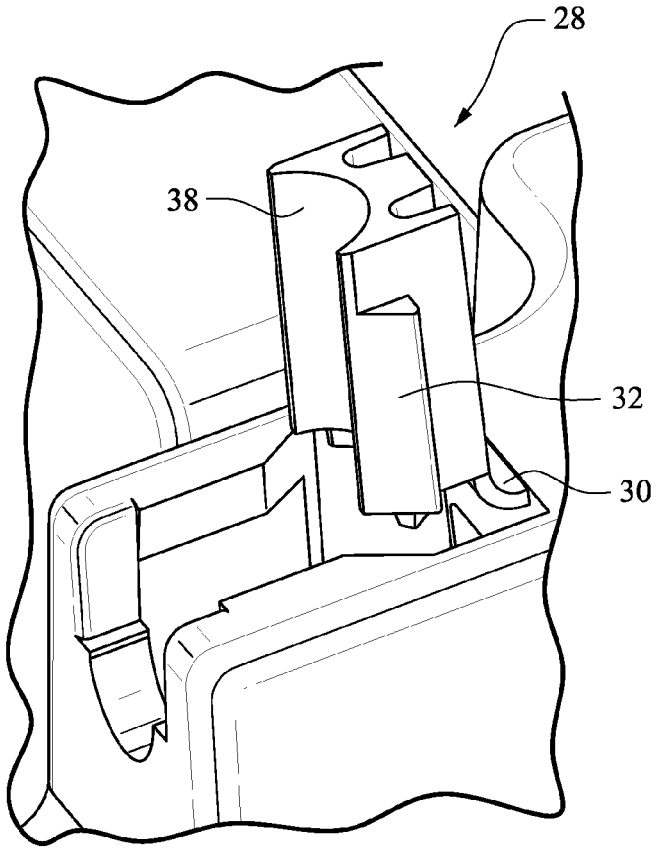
FIG. 7 shows the hinge pin lock in an open position.
Figure 8:
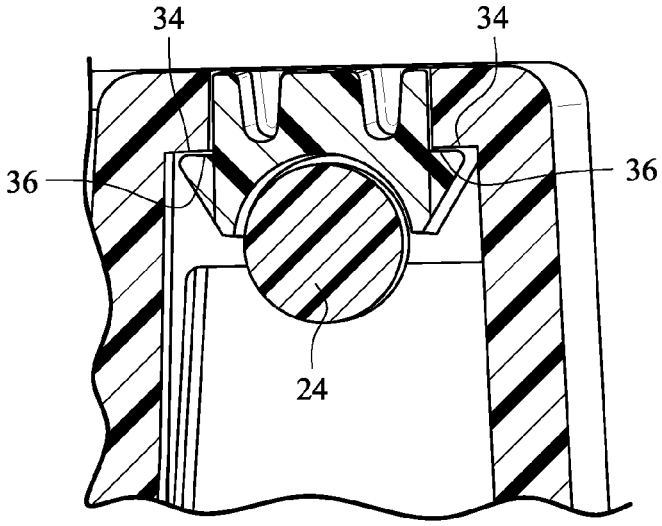
FIG. 8 is a sectional view showing the hinge pin lock in a locked position and securing a hinge pin of the container lid.

The lock channels 20 include engagement structure that secures the locking tab 28 in a locked position. With reference to FIGS. 7 and 8, the locking tab includes at least one, preferably two, hooks 32 that engage the engagement structure in the lock channel 20 in the locked position. The engagement structure may be defined by shoulders 34 in the lock channel 20. The hooks 32 are constructed with a reverse tapered surface and a shelf 36. In a locked position, the shelf 36 of each hook 32 engages a corresponding one of the shoulders 34 in the lock channel 20.

After securing the hinge pins 24 of the container lid 22 in the channels 18, 20, the locking tab 28 is pivoted from its open position to the lock position. As the reverse tapered surfaces of the hooks 32 engage the channel opening, the channel opening is displaced outward until the shelf 36 of the locking tab 28 clears the shoulders 34 of the channel 20. The channel 20 then resiliently retracts to a position in which the locking tab 28 is locked in place (see FIG. 8). Once locked, the hinge pin 24 cannot be removed without breaking the hinge pin or damaging the locking tab 28 with a tool.

To facilitate opening and closing of the container lid 22, an inside surface 38 of the locking tab 28 is formed as a curved recess that is shaped to accommodate the hinge pin 24. The channels 18, 20 define a curved pocket that is shaped to accommodate the hinge pins. The curved recess of the inside surface 38 and the curved pocket define a substantially cylindrical "cage" for the hinge pin 24. With the locking tab 28 in its locked position, the hinge pin 24 is easily rotatable to facilitate opening and closing of the lid 22.

The structure of the preferred embodiments replaces the conventional metal hinge pin with molded plastic hinge pins while maintaining security and automated manufacturing features. The hinge pin lock includes a locking tab that is connected to the container by a living hinge and molded with the container. The use of all plastic materials also provides for easy recyclability.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A hinge pin lock for a molded plastic container, the hinge pin lock comprising:

a locking tab molded with an upper rim of the container and connected to the upper rim by a living hinge, the locking tab being pivotable from an open position to a locked position; and a channel formed in the upper rim, the channel having an upwardly facing opening and being sized to receive a hinge pin of a container lid, wherein the locking tab in the open position is pivotable by the living hinge to a position substantially perpendicular to the upward facing opening of the channel such that the channel can receive the locking tab and the hinge pin, the channel including engagement structure that secures the locking tab in the locked position.

2. A hinge pin lock according to claim 1, wherein the locking tab comprises at least one hook that engages the engagement structure in the locked position.

3. A hinge pin lock according to claim 2, wherein the locking tab comprises two hooks on opposite sides thereof, the hooks engaging the engagement structure in the locked position.

4. A hinge pin lock according to claim 3, wherein the hooks comprise a reverse tapered surface and a shelf, and wherein the engagement structure comprises shoulders corresponding to each shelf of the hooks, the shelf of each hook engaging a corresponding one of the shoulders in the locked position.

5. A hinge pin lock according to claim 1, wherein an inside surface of the locking tab comprises a curved recess that is shaped to accommodate the hinge pin.

6. A hinge pin lock according to claim 5, wherein the channel defines a curved pocket that is shaped to accommodate the hinge, the curved recess and the curved pocket defining a substantially cylindrical cage for the hinge pin.

7. A container comprising:

a container body including an upper rim;

a container lid pivotably secured to the upper rim via a hinge pin; and a hinge pin lock formed in the upper rim of the container body and securing the hinge pin, the hinge pin lock including:

a locking tab molded with the upper rim and connected to the upper rim by a living hinge, the locking tab being pivotable from an open position to a locked position, and a lock channel formed in the upper rim, the lock channel being sized to receive the hinge pin of the container lid, the lock channel including engagement structure that secures the locking tab in the locked position, wherein the container lid comprises a plurality of integral hinge pins, and wherein the upper rim comprises a plurality of pin channels, the integral hinge pins being secured in the pin channels, wherein the locking tab comprises two hooks on opposite sides thereof, the hooks engaging the engagement structure in the locked position, wherein the hooks comprise a reverse tapered surface and a shelf, and wherein the engagement structure comprises shoulders corresponding to each shelf of the hooks, the shelf of each hook engaging a corresponding one of the shoulders in the locked position.

8. A container according to claim 7, wherein the container body comprises two long sides and two short sides, and wherein the pin channels are positioned along the long sides, the container comprising four hinge pin locks spaced along each of the long sides.

9. A container according to claim 7, wherein the pin channels are constructed such that the hinge pins are secured in the pin channels in a snap fit.

10. A container according to claim 7, wherein an inside surface of the locking tab comprises a curved recess that is shaped to accommodate the hinge pin.

11. A container according to claim 10, wherein the channel defines a curved pocket that is shaped to accommodate the hinge, the curved recess and the curved pocket defining a substantially cylindrical cage for the hinge pin.

12. A method of making a plastic container comprising:

(a) molding a container body including an upper rim; and (b) molding a container lid pivotably securable to the upper rim via an integrally molded hinge pin, wherein step (a) comprises integrally molding a hinge pin lock in the upper rim by:

molding a locking tab with the upper rim and connecting the locking tab to the upper rim by a living hinge, the locking tab being pivotable from an open position to a locked position, and molding a lock channel in the upper rim with an upwardly facing opening to receive the hinge pin of the container lid, wherein in the open position, the locking tab is pivotable by the living hinge to a position substantially perpendicular to the upward facing opening of the channel such that the channel can receive the locking tab and the hinge pin, wherein molding the lock channel comprises molding engagement structure with the lock channel that is shaped to secure the locking tab in the locked position.

13. A method according to claim 12, wherein step (b) comprises molding the container lid with a plurality of hinge pins, and wherein step (a) comprises forming a plurality of pin channels in the upper rim, the method further comprising assembling the plastic container by:

securing the hinge pins of the container lid in the pin channels of the container body;

securing at least one of the hinge pins in the lock channel with the locking tab in the open position; and pivoting the locking tab from the open position to the locked position to lock the at least one of the hinge pins in the lock channel.

* * * * *